US005763807A

United States Patent [19]

Clynes

[11] Patent Number: 5,763,807

[45] Date of Patent: Jun. 9, 1998

[54] ELECTRONIC MUSIC SYSTEM PRODUCING VIBRATO AND TREMOLO EFFECTS

[76] Inventor: Manfred Clynes, 19181 Mesquite Ct., Sonoma, Calif. 95476

[21] Appl. No.: 712,882

[22] Filed: Sep. 12, 1996

[51] Int. Cl.[6] ..... G10H 1/043

[52] U.S. Cl. ..... 84/705; 381/62

[58] Field of Search ..... 84/629, 662–665, 84/705, 706, 739, 740; 381/62

[56] References Cited

U.S. PATENT DOCUMENTS

| | | | |
|---|---|---|---|
| 2,905,040 | 9/1959 | Hanert | 84/706 |
| 3,257,495 | 6/1966 | Williams | 84/706 |
| 3,378,623 | 4/1968 | Park | 84/705 |
| 3,626,077 | 12/1971 | Munch et al. | 84/706 X |
| 3,973,462 | 8/1976 | Uchiyama | 84/705 |
| 4,072,079 | 2/1978 | Sharp | 84/706 |
| 4,304,162 | 12/1981 | Schreier | 84/706 |

*Primary Examiner*—Stanley J. Witkowski

*Attorney, Agent, or Firm*—Michael Ebert

[57] ABSTRACT

An electronic music system adapted to generate tone waves of different pitch, amplitude and duration which, when reproduced, create musical tones whose expressive qualities emulate the expressive quality of natural tones producible by acoustic instruments or the human voice. The system includes a tone wave generator, the carrier of which is frequency modulated by an asymmetrical wave whose major component is a sinusoidal wave and whose minor component superimposed on the sinusoidal wave is the second harmonic of that wave. The frequency of the sinusoidal wave is such that as the carrier is frequency-modulated, its frequency is periodically varied above and below its normal value so that the resultant tone exhibits a vibrato effect. And the carrier is at the same time amplitude modulated so that it is periodically varied in amplitude to impart to the resultant tone a tremolo effect whereby the tone yielded by the system emulates a natural tone. The rise and fall time of the vibrato on the tones is variable and related to the musical structure.

13 Claims, 2 Drawing Sheets

ELECTRONIC MUSIC SYSTEM PRODUCING VIBRATO AND TREMOLO EFFECTS

BACKGROUND OF INVENTION

1. Field of Invention

This invention relates generally to electronic music systems adapted to produce tones of different pitch, amplitude and duration, and more particularly to a system of this type in which an electronically-generated tone is frequency-modulated to impart vibrato thereto and is amplitude modulated to impart tremolo thereto, the combined effects of vibrato and tremolo rendering the tone more natural and expressive.

2. Status of Prior Art

The standard system of music notation employs characters to indicate tone. The duration of a tone (whole, half, quarter, etc.) is represented by the shape of the character, and the pitch of each tone by the position of the character on a staff. While the notation of a musical score gives the nominal values of the tones, in order for a performer to breathe expressive life into the composition, he must read into the score many nuances that are altogether lacking in standard notation. Almost all departures from the nominal values of the tones appearing in the score depend on the interpretive power of the performer.

Thus a musical score may indicate whether a section of the score is to be played loudly (forte) or softly (piano) without however indicating a quantitative relation between forte and piano. And the score does not generally specify the relative loudness of component tones either of a melody or of a chord with anything approaching the degree of discrimination required by the performer. The performer therefore must decide for himself how loudly specific notes are to be played to render the music expressive.

Equally important to an effective performance of music is the amplitude contour of each tone in the succession thereof. To satisfy musical requirements, the amplitude envelopes of the tones must be individually shaped. Though amplitude contours are completely unspecified in standard notation, each performer, such as a violinist who has the freedom to shape tones, does so in actual performance in order to impart expressivity thereto.

Other factors which come into play are subtle deviations from the temporal values prescribed in the score. Thus, to avoid temporal rigidity which dehumanizes music and to impart meaningful expression thereto, the performer will in actual practice amend the nominal duration values indicated by standard notation.

Thus the "macrostructure" of a musical composition is defined in the score by standard notation. But if one executes this score by being faithful only to the notes as given in the score, the resultant performance, however expertly executed, will be bereft of vitality and expression. The term "microstructure" as used herein encompasses all subtle deviations from the nominal values of the score in terms of amplitude size and shaping, timing, timbre, vibrato and all other factors which endow music with feeling and expressiveness.

My prior U.S. Pat. No. 4,763,257 (Clynes) discloses a computerized system in which entered into the computer are the nominal values of the notes which make up a particular music composition, the nominal pitch and duration of each note being entered. These nominal values of the notes of the score are processed by the computer by a microstructure stored in a matrix. The microstructure acts to modify the nominal values of the notes with respect to their amplitude envelope, and duration as well as to impart other deviations thereto whereby the system reproduces the music composition in a manner which renders it expressive.

Also disclosed in the Clynes patent is the use of a Beta Function having only two parameters $P_1$ and $P_2$ to define a wide range of different shapes for the amplitudes of individual tones and for predictively shaping the amplitude of one tone in accordance with what the amplitude of the next tone is going to be and when it is to occur.

The concern of the present invention is with an aspect of tonal modification known as vibrato, for vibrato which is usually accompanied by tremolo, plays a vital role in rendering electronically-generated music expressive and natural sounding. In the absence of vibrato and tremolo, music generated by steady tones, however perfectly executed, is cold and as devoid of expression as a flat voice.

Vibrato is a pulsatory effect produced in an instrument or voice by minute and rapid changes in pitch. Vibrato therefore is a periodic variation in the frequency of a tone from its average value and is produced by frequency-modulating the tone. The degree to which the frequency of a tone is varied by vibrato may be as much as 2 or 3 percent above and below the average value of the tone. The repetition rate or modulation frequency of vibrato is usually in the range of five to eight cycles per second.

Though a typical acoustic instrument is capable of producing steady tones, the musician playing this instrument will deliberately introduce periodic variations in the frequency and amplitude of the tones in order to render the tones more expressive than steady tones. Just as a voice is rendered tremulous by emotion, when subjected to vibrato musical tones have a greater emotional impact.

When a musical tone is only amplitude-modulated and its pitch remains unchanged, this is referred to as tremolo. But if the tone is both amplitude and frequency modulated, so that what the listener mainly hears is a tone whose pitch is periodically varied in frequency, this is generally referred to as vibrato, even though the tone may includes a tremolo component.

In a violin, vibrato gives the tones produced by bowing the strings their characteristic qualities. While vibrato in a violin includes a tremolo component, this is of lesser importance than the periodic variations in the frequency of the tone. Vibrato is produced in a violin when the player moves his fingers back and forth on a string so as to periodically vary its effective length. The resultant frequency or repetition rate of the vibrato, as distinguished from the frequency of the string, is usually five to six vibrations per second.

The vibrato frequency of a violin varies in a range of 10 to 30 cents. A cent is a unit equal to 1/100 of a semitone. Thus in a modern piano scale, an octave is equal to 12 semitones and therefore to 1200 cents, while a whole tone is 200 cents.

In electronic instruments and music synthesizers in which musical tones are produced by oscillators, it is not difficult to produce a tremolo by amplitude-modulating a tone-generating oscillator, or to produce a vibrato by frequency-modulating the oscillator.

The most commonly used technique for imparting vibrato to a musical tone produced by a computer or oscillator in a music synthesizer is to frequency-modulate the carrier of the oscillator with a low-frequency sinusoidal wave. The sinusoidal wave is superimposed on the tone carrier for a variable settable period, starting at the beginning of the tone or at a later point in time, and continuing to the end of the tone. The period set is applied uniformly to the entire performance, with consequently poor results.

In a music synthesizer, or computer, instead of a sinusoidal wave to effect frequency modulation of the tone, vibrato may also be produced by means of a wave having a square, triangular or sawtooth wave formation. But sinusoidal wave modulation has distinct advantages, for other wave forms give rise to a deterioration in musical quality. Thus square wave modulation imparts a harsh quality to the vibrato.

However, we have found that a vibrato effect in electronic musical instruments produced by means of a sinusoidal wave which frequency-modulates the tone is not comparable in quality or naturalness to vibrato produced by a musician playing an acoustic instrument, for the electronically-produced vibrato is somewhat unnatural and introduces a certain edginess or sharpness to the tone.

Thus in a violin, the vibrato effect produced by to and fro movement of the fingers along the string is not symmetrical in nature, for the muscles of the fingers are better able to pull than to push. As a consequence, "to" motion of the vibrato phase is different from the "fro" motion, this being characteristic of a natural vibrato.

Hence it is the lack of symmetry in a vibrato produced by playing a violin that gives this vibrato its seemingly imperfect yet natural quality. But in an electronic system in which vibrato is produced by frequency-modulating a tone with a sinusoidal wave, the resultant vibrato is symmetrical and therefore fails to simulate a natural vibrato. Symmetry effectively dehumanizes vibrato, just as a sculptured bust of a perfectly symmetrical human head having perfectly even features is static and unnatural.

It is known to produce a vibrato effect in electronic instruments in which the tones emanate from loud speakers by continuously rotating the speakers to provide the necessary periodic frequency change by means of the Doppler effect. Since the resultant vibrato is symmetrical, it lacks the natural quality of vibrato produced by a musician playing an acoustic instrument.

SUMMARY OF INVENTION

In view of the foregoing, the main object of this invention is to provide an electronic music system for producing tones exhibiting vibrato and tremolo effects that simulate natural tones and are therefore highly expressive.

More specifically, an object of this invention is to provide in an electronic system of the above type modulating means to impart to a musical tone produced by a tone generator, a vibrato effect that is asymmetrical and therefore has a natural quality.

Also an object of the invention is to provide a system of the above type in which the generated music tone is both frequency and amplitude modulated to provide a vibrato having a tremolo component to further enhance the naturalness of the tone.

A further object of the invention is to provide means to vary the placement and the rise and fall of the vibrato throughout the piece so that each note automatically receives an individually-shaped form of vibrato rather than a uniformly-shaped vibrato as in prior computer and electronic synthesizer systems time amplitude-modulated so that it is periodically varied in amplitude to impart to the resultant tone a tremolo effect whereby the tone yielded by the system emulates a natural tone.

BRIEF DESCRIPTION OF DRAWING

For a better understanding of the invention as well as other objects and further features thereof, reference is made to the following detailed description to be read in conjunction with the accompanying drawings, wherein.

DESCRIPTION OF INVENTION

A computer or electronic music system in accordance with the invention is adapted to generate tone waves of different pitch, amplitude and duration which, when reproduced, create musical tones whose expressive qualities emulate natural tones producible by acoustic instruments. For this purpose the system may be of the type shown in the above-identified Clynes patent or a standard music synthesizer, modified in the manner to be described to impart vibrato to the tones.

A system in accordance with the invention includes modulating means coupled to the tone wave generator for frequency-modulating the tone wave with an asymmetrical wave to impart natural vibrato to the resultant tone and for concurrently amplitude-modulating the tone wave to impart tremolo thereto. The combined effect of vibrato and tremolo render the reproduced tone more natural and expressive.

Figure 1:
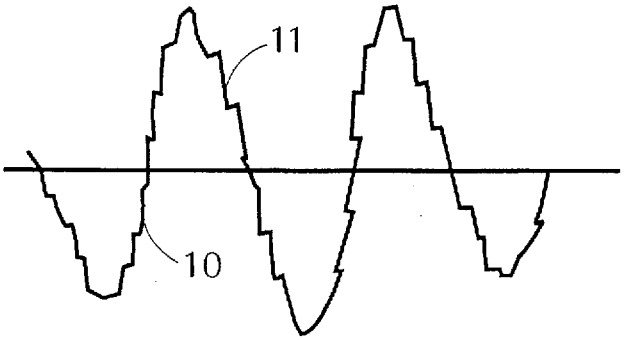
FIG. 1 shows the wave form of an asymmetrical wave produced in a system in accordance with the invention to frequency-modulate a tone wave to impart vibrato thereto.

As shown in FIG. 1, an asymmetrical wave for frequency-modulating the carrier of the tone generator is the resultant of a major component 10 on which is superimposed a minor component 11. The major component 10 is a low-frequency sinusoidal wave in the sub-audio range and the minor component 11 is a wave of relatively low amplitude whose frequency is a second harmonic of the sinusoidal wave. In practice, the relative amplitude of the minor component is preferably in the order of 12 percent of the major component.

The nature of the sinusoidal wave component of the asymmetrical wave is such that when the carrier of the tone generator is frequency-modulated by the asymmetrical wave, the frequency of the carrier is then varied periodically above and below its normal value six to eight times per second to impart a vibrato effect to the resultant tone. This repetition rate can be made adjustable to provide a desired vibrato effect.

It will be seen in FIG. 1 that the superimposed second harmonic 11 assumes a stepped staircase formation on the curvature of the sinusoid and slants the wave slope in one direction. This simulates the natural asymmetric behavior of a human muscle system involved in producing vibrato in a violin.

The phase of the second harmonic may, in practice, be inverted 180 degrees, in which event the sloping goes in the opposite direction. Preferably, the phase should be such that the vibrato is steepest as it increases the frequency of the tone and less steep as it relaxes from this increase.

In order to enhance the natural sound of the tone reproduced by the system, some degree of tremolo is added to the vibrato. In practice the ratio of vibrato to tremolo is adjusted to attain an optional degree of natural sound. We have found that a preferred ratio is 10% amplitude tremolo for 10 cents of frequency vibrato.

Figure 2:
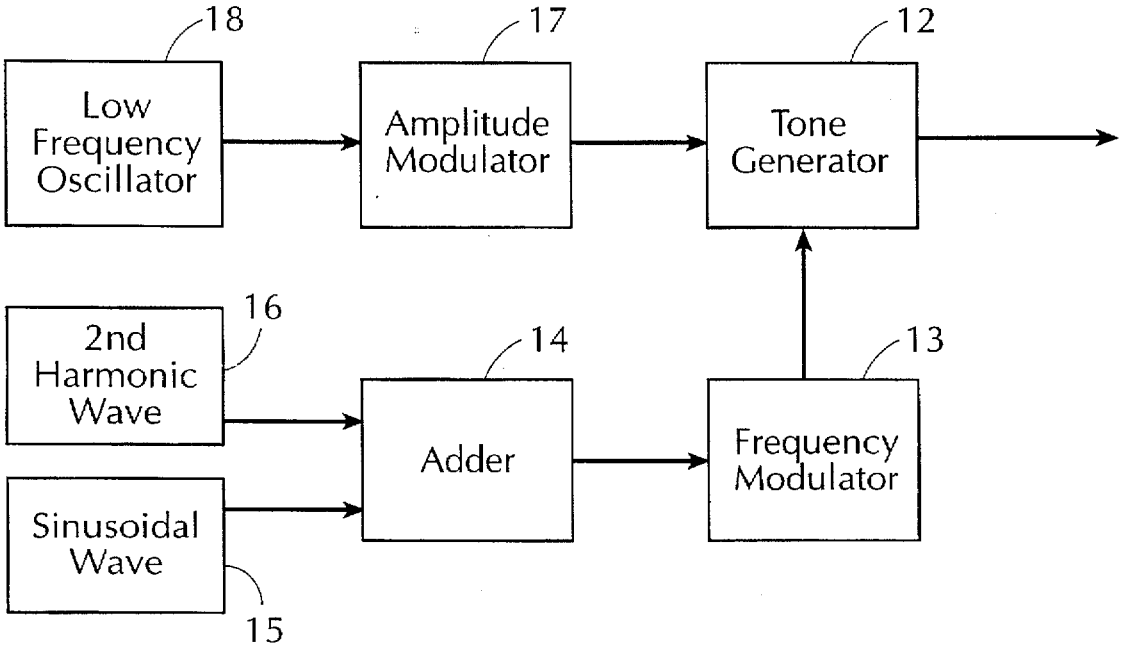
FIG. 2 is a block diagram of a system in accordance with the invention frequency and amplitude modulate a tone wave to impart vibrato thereto having a tremolo component.

FIG. 2 illustrates in block diagram one form of electronic circuit for producing a tone wave which is concurrently frequency modulated to produce vibrato and amplitude-modulated to produce tremolo. Thus the tone, as its frequency is periodically varied, is at the same time periodically varied in amplitude to produce a tone having a natural rather than a synthetic or artificial sound.

A tone wave having a predetermined fundamental frequency in the sonic range is produced by a tone generator 12. Coupled to tone generator 12 is a frequency-modulator 13 to which is applied the output of an adder 14. Fed into adder 14 is a low-frequency sinusoidal wave from an oscillator 15, and a wave produced in an oscillator 16 which is the second harmonic of the sinusoidal wave, the second harmonic being superimposed on the sinusoidal wave in the adder. The resultant asymmetrical wave yielded by adder 14 acts to frequency-modulate the tone wave yielded by generator 12 to impart vibrato thereto.

Also coupled to tone generator 12 is an amplitude modulator 17 to which is applied a low-frequency wave of constant amplitude produced by an oscillator 19. Amplitude-modulator 17 imparts a tremolo component to the tone wave yielded by generator 12.

Figure 3:
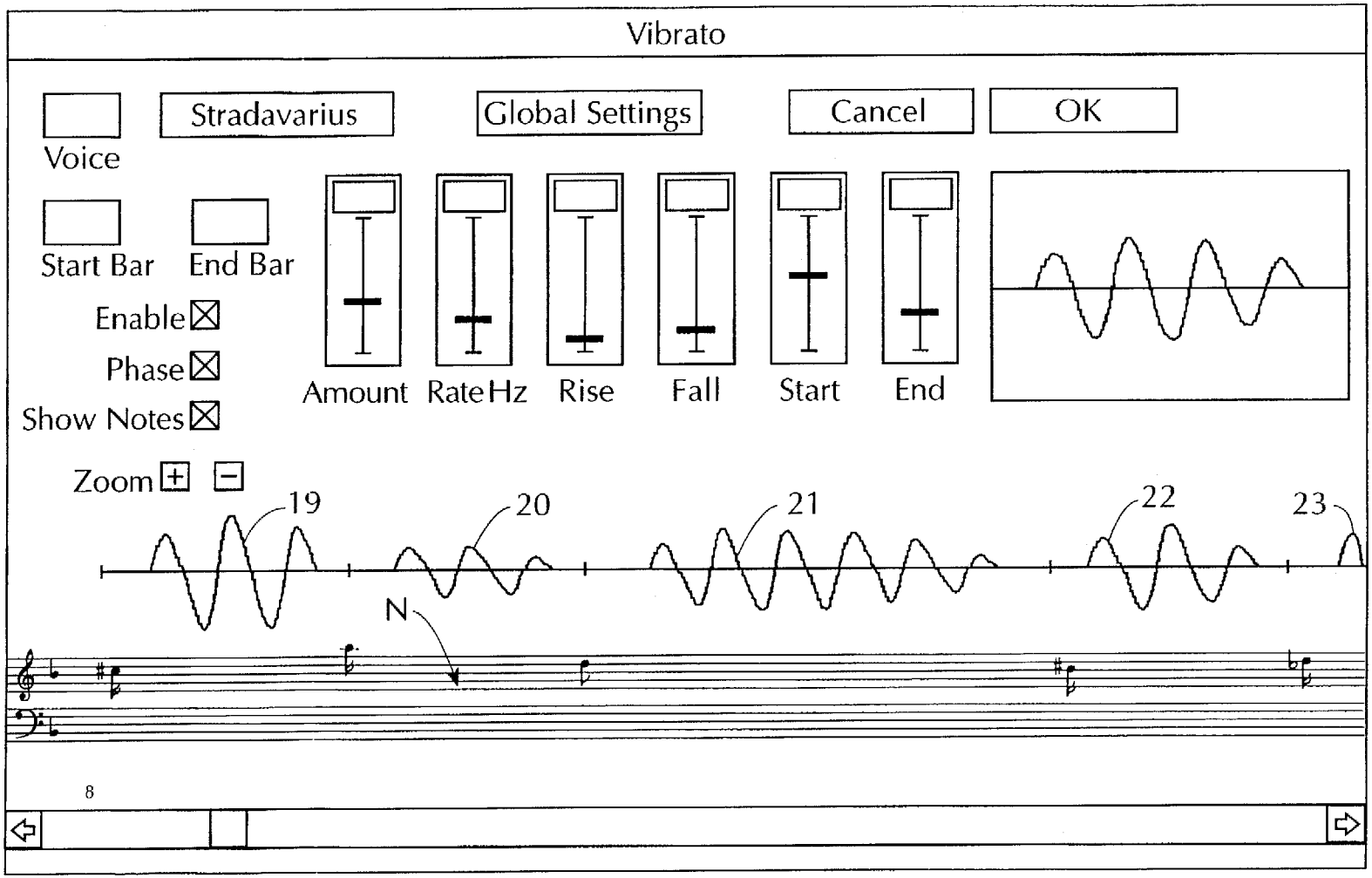
FIG. 3 shows the vibrato section of a computer or music synthesizer having a system in accordance with the invention.

As shown in FIG. 3 the vibrato section of the computer or electronic music system displays the notation N of a musical score presenting a series of notes of different pitch and duration. The first note is frequency modulated by an asymmetrical wave 19, the second by an asymmetrical wave 20, the third by an asymmetrical wave 21, the fourth by an asymmetrical wave 22, the fifth by an asymmetrical wave 23 and so on; to impart vibrato to the music tones produced by these notes.

As previously noted, the system disclosed in the Clynes patent includes means to effect predictive shaping of the amplitude envelopes of the notes in a musical score whereby the amplitude of a present note is shaped in accordance with what the next note is going to be and when it occurs.

The vibrato (and/or tremolo) imparted to a note in the manner of the present invention may be predictively changed in a manner similar to that disclosed in the above-identified Clynes patent whereby the vibrato is varied from note to note automatically as a function of the melodic structure. To this end use is made of the Beta Function parameters $P_1$ and $P_2$ as calculated by the equation set forth in the Clynes patent to change the placement of the vibrato on the note, shifting it forward or backward. This is a useful expressive technique, for it allows vibrato to place itself differently and appropriately on a note that is rising, as compared with a note that is descending.

Thus the direction of movement influences the amount, the placement and the rise and fall of vibrato on the note, making it come later and stronger on the note when the note is rising, as if the effort of rising were expressed by the vibrato; thereby enhancing the naturalness of the sound.

Moreover, since one can stretch a giving shape over the notes, regardless of what the duration of the note is, even if there were no predictive amplitude shaping, the rise and fall of the vibrato will depend on the duration of the note, apart from any modulation of the rise or fall. This means that since the note, that the number of vibrato cycles it takes for the vibrato to rise and fall will vary greatly with the duration of the note, in any case. (Short notes will have a rapid rise and fall, virtually eliminating the rise and fall, and very long notes a very gradual rise and fall. These properties are then altered by the predictive aspects, i.e., looking at what the next note is going to be and when.)

Vibrato altered by the predictive function, such as the Beta Function parameters $P_1$ and $P_2$ may be effected in two ways. One is by placement on the note which is shifted according to the values of these parameters depending on whether the next note is higher or lower and according to when the next note occurs.

Another way is to alter the rise and fall of vibrato by $P_1$ and $P_2$ is the same way as the amplitude shape of the note itself is changed. Thus the rise may be faster for small $P_1$ values and slower for large $P_1$ values, while the fall is faster for small $P_2$ values and slower for large $P_2$ values.

Vibrato affected by the predictive functions as guided by the $P_1$ and $P_2$ parameters is such that a note followed quickly by a higher note will have more vibrato imparted thereto, while a note followed quickly by a lower note will have less vibrato imparted thereto than a note followed by a similar note. In terms of expression, this simulates a greater exertion in order to reach the next higher note and a relaxation of effort when the next note is going to be lower.

The amount of tremolo or amplitude vibrato is variable in relation to frequency vibrato by a parameter. Thus we can have a variable proportion of tremolo relative to frequency vibrato, the variable amount being a constant ratio that can be adjusted for each piece but stays the same during a particular piece.

When a second harmonic is added to the sinusoidal wave which modulates a tone to produce a frequency vibrato effect, the resultant side bands are different from those produced by a sinusoidal wave alone. It is because of these side bands that the sound quality of the note is enhanced. Even though the side bands are in part in the sub-audio range, they still have an effect on the perceived quality, for the side bands have a persistence in auditory perception.

A particular quality is generated and perceived over time, typically a fraction of a second, that is not necessarily coincident in time with the actual production of the side bands. The human ear acts as a harmonic analyzer, but it takes some time to carry out this analysis, in the order of 40 milliseconds.

Accordingly what the ear hears is not what happens instantaneously, but with a kind of time filter that smooths the side bands in a temporal sense and gives an overall impression of tone quality.

The resultant improvement in quality has been characterized previously as producing a more natural tone in that it emulates the tone produced by vibrato with an acoustic instrument. But regardless of whether it is truly natural, the tone quality produced with a system in accordance with the invention is more expressive than a tone produced electronically in which vibrato of a tone is effected by frequency-modulation with a sinusoidal, a sawtooth or other wave form.

While there has been shown preferred embodiments of the electronic music system emulating natural musical tones in accordance with the invention, it will be appreciated that many changes and modifications may be made therein without, however, departing from the essential spirit thereof.

I claim:

1. An electronic music system adapted to generate tones of different pitch, amplitude and duration which, when reproduced, create musical sounds that emulate those produced by acoustic instruments, said system comprising:

A. a tone generator producing a sonic wave having a carrier of a predetermined frequency;

B. means to generate an asymmetrical wave composed of a low-frequency sinusoidal wave having a predetermined amplitude and a frequency in a range producing a vibrato, said sinusoidal wave having superimposed thereon a secondary wave of low amplitude relative to that of the sinusoidal wave and having a frequency which is a second harmonic of the sinusoidal wave to impose a stepped staircase formation on the curvature of the sinusoidal wave; and C. means to frequency-modulate the sonic wave with said asymmetrical wave to periodically vary the frequency of the carrier above and below said predetermined frequency to impart vibrato to the resultant musical sound.

2. A system as set forth in claim 1, in which the phase of the second harmonic wave is the same as that of the sinusoidal wave.

3. A system as set forth in claim 1, in which the phase of the second harmonic wave is inverted with respect to that of the sinusoidal wave.

4. A system as set forth in claim 1, in which the means to frequency-modulate the sonic wave causes the frequency of the sonic wave to vary to about 3 percent above and below its predetermined frequency.

5. A system as set forth in claim 1, in which said vibrato is in the range of about five to eight cycles.

6. A system as set forth in claim 1, further including means to amplitude-modulate the sonic wave to impart tremolo to the resultant musical sound.

7. A system as set forth in claim 6, further including an amplitude-modulator coupled to said tone generator to which is applied a low-frequency wave to produce said tremolo.

8. A system as set forth in claim 1, including a frequency-modulator coupled to said tone generator, a sinusoidal wave oscillator to which is added a second harmonic wave to create said asymmetrical wave applied to said frequency modulator.

9. A system as set forth in claim 1, including means to alter the vibrato impart to said tone in accordance with a predictive function having predetermined parameters.

10. A system as set forth in claim 9, in which the amount of vibrato imparted to a given tone depends on what the next tone is going to be and when it is generated.

11. A system as set forth in claim 10, in which the amount of vibrato applied to a given tone is greater when the given tone is quickly succeeded by a higher tone and is lesser when the given tone is quickly succeeded by a lower tone.

12. A system as set forth in claim 10, in which the placement of vibrato applied to a given tone is different when the given tone is quickly succeeded by a higher tone than when the given tone is quickly succeeded by a lower tone.

13. A system as set forth in claim 10, in which the rise and fall of the vibrato applied to a given time is different when the given tone is quickly succeeded by a higher tone then when the given tone is quickly succeeded by a lower tone.

* * * * *